US007237464B2

(12) United States Patent
Mekler

(10) Patent No.: US 7,237,464 B2
(45) Date of Patent: Jul. 3, 2007

(54) FASTENING TOOL FOR SCREW THREADED BOLTS

(76) Inventor: Dan Mekler, 6 Israel Eldad Street, Jerusalem 93399 (IL)

( * ) Notice: Subject to any disclaimer, the term of this patent is extended or adjusted under 35 U.S.C. 154(b) by 14 days.

(21) Appl. No.: 10/561,890

(22) PCT Filed: Jun. 22, 2004

(86) PCT No.: PCT/IL2004/000555

§ 371 (c)(1),
(2), (4) Date: Dec. 21, 2005

(87) PCT Pub. No.: WO2004/113026

PCT Pub. Date: Dec. 29, 2004

(65) Prior Publication Data

US 2007/0101834 A1 May 10, 2007

(30) Foreign Application Priority Data

Jun. 25, 2003 (IL) ..... 156633

(51) Int. Cl.
*B25B 13/48* (2006.01)

(52) U.S. Cl. ..... 81/441; 81/176.15; 81/461

(58) Field of Classification Search ..... 81/436, 81/443, 461, 441, 176.15, 176.3, 176.2
See application file for complete search history.

(56) References Cited

U.S. PATENT DOCUMENTS 2,860,675 A * 11/1958 Kauffman ..... 81/176.15
4,302,137 A * 11/1981 Hart ..... 411/432
RE33,114 E * 11/1989 Chiavon ..... 81/121.1
4,938,108 A * 7/1990 Mekler ..... 81/176.15
5,988,023 A * 11/1999 Townsend et al. ..... 81/443
6,089,396 A * 7/2000 Pozek ..... 81/461

FOREIGN PATENT DOCUMENTS

DE 3924323 A1 * 1/1991

* cited by examiner

*Primary Examiner*—Hadi Shakeri
(74) *Attorney, Agent, or Firm*—Blakely Sokoloff Taylor & Zafman

(57) ABSTRACT

Provided according to the invention is a fastening tool (10) for tightening/untightening screw threaded fasteners such as bolts or nuts (18). The bolts (18) comprise a head formed with a series of at least three cavities (18*a*) deployed therearound. The fastening tool (10) comprises at least three peanut-shaped displaceable locking bodies (16) having spherical portions (16*a*; 16*b*), and a restricted neck portion (16*c*) therebetween. The cavities (18*a*) of the bolt (18) are configured to receive the spherical portions (16*b*). A seat member (12) is provided, formed with a series of at least three cavities (22) configured to receive the spherical portions (16*a*). Further provided is a manipulator (14) for rocking the locking bodies (16) about their neck portions (16*c*) from a non-operative position wherein the spherical portions (16*a*) are seated in the cavities (22), into an operative position wherein the spherical portions (16*b*) are seated in the bolt cavities (18*a*), and vice versa.

13 Claims, 7 Drawing Sheets

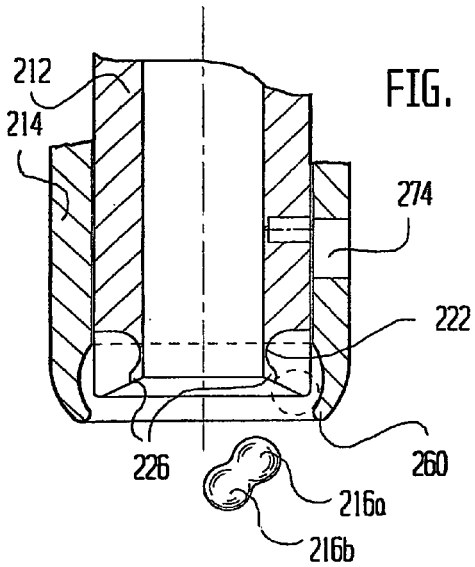
FIG. 10
FIG. 11
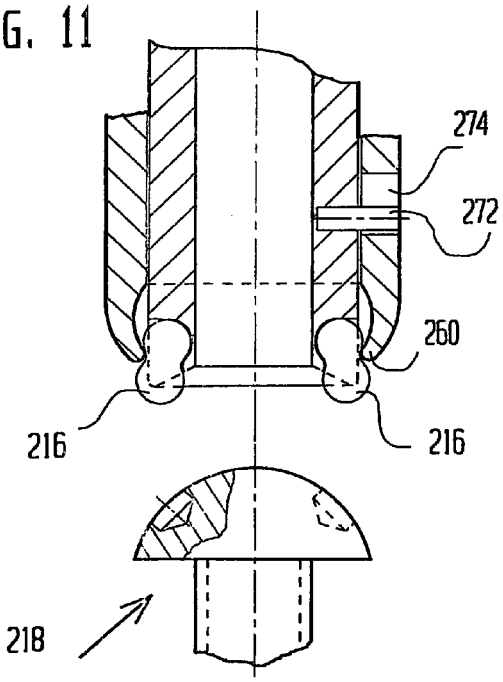
FIG. 12
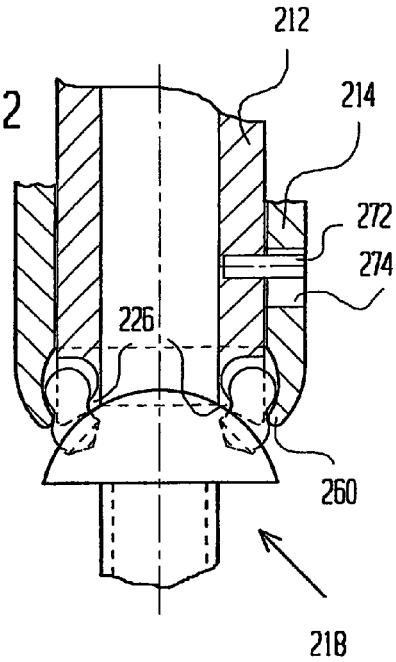

FASTENING TOOL FOR SCREW THREADED BOLTS

The present patent application is a non-provisional application of International Application No. PCT/IL2004/000555, filed Jun. 22, 2004.

BACKGROUND OF THE INVENTIONS

In U.S. Pat. No. 4,938,108 to the present inventor, the contents of which being hereby incorporated by reference (hereinafter referred to as "the Prior Patent"), there has been disclosed a theft resistant fastener system which included a rotatable wrench adapted to engage the head portion of the fastener. The wrench and fastener comprised at least three ball-and-socket joints distributed about the fastener axis. Each of these ball-and-socket joints included a ball in the wrench and a socket in the head portion of the fastener, with each socket being provided with a circular cross-section about a socket axis extending at an acute angle to the fastener axis. The wrench comprised a releasable actuator for pressing the balls into respective sockets preparatory to and during rotation of the wrench about the fastener axis. For preventing the clearing the balls from the head while being pressed into the sockets, the head portion at each socket was formed with an overhang extending over part of the ball. The need for auxiliary means for biasing the balls out of the sockets upon release of the actuator has been avoided by providing each overhang with an outer limit closer to the fastener axis than a center of the corresponding one of the balls of the ball-and-socket joints. Actuation of the fastener by a conventional wrench was prevented by providing the head portion with outward extending slopes at the sockets and otherwise about the fastener axis.

Certain limitations of the Prior Patent system have led the present inventor to further develop the conceptual approach therein disclosed. The main limitation relates to the holding or gripping method of the balls by the wrench. As clearly seen and described, the balls are enclosed within sockets formed in the wrench actuator. In order to prevent the balls from free-falling out of their sockets (during non-use of the wrench) it is mandatory to provide a circumferential barrier—whether continuous or at least at three equally distanced locations ("overhang" or "edges" 84 in FIGS. 2A, 2B of the Prior Patent). The fulfillment of this condition dictated that the exposed, "active" portion of each ball be less than half, and practically only about one third.

This inevitable requirement has caused the following drawbacks: It has limited the amount of torque that could be applied by the wrench depending on the strength of the material (metal) of which the bolt has made; and, it has set a limit to the miniaturization degree of the tool. For example, bolts of, say, 3 mm diameter are ruled-out in as much as the Prior Patent system is concerned.

From another aspect, although derived from the above, the Prior Patent system is properly applicable with regard to dome-shaped (semi-spherical or round cap) bolts. This is due to the fact that in order to assure smooth, unimpeded release of the balls from the bolt head sockets back into the wrench sockets, both must be aligned, and the common axis thereof (designated 352 in FIG. 2A of the Prior Patent) must be inclined at an acute angle relative to the bolt axial axis. Therefore, bolts other than of round cap bolts (or nuts) such as PAN bolts or countersunk (flat-headed) bolts were unsuitable to be handled by the Prior Patent wrench system.

It is therefore the general object of the invention to overcome the above listed and other deficiencies of the Prior Patent system, while still maintaining the outstanding advantages thereof.

It is a further object of the invention to substitute the balls configuration by one that will enable enhanced torque transmission capabilities.

SUMMARY OF THE INVENTION

Thus provided according to the invention is a fastening tool for tightening/untightening screw threaded fasteners such as bolts or nuts having a head formed with a series of at least three first cavities deployed therearound, the tool comprising: at least three peanut-shaped displaceable locking bodies having a first substantially spherical portion, a second substantially spherical portion, and a restricted neck portion therebetween; the said first cavities being configured to receive the said first spherical portions; a seat member formed with a series of at least three second cavities configured to receive the said second spherical portions; and means for rocking the bodies about their neck portions from a position wherein the second spherical portions are seated in the second cavities, into a position wherein the first spherical portions are seated in the said first cavities, and vice versa.

BRIEF DESCRIPTION OF THE DRAWINGS

These and additional characteristic features and advantages of the invention will become more clearly understood in the light of the ensuing description of several preferred embodiments thereof, given by way of example only with reference to the accompanying drawings, wherein:—

FIG. 10 illustrates a modified embodiment of the wrench head in an intermediate assembly stage;

FIG. 11 shows the head of FIG. 10 in the preparatory position;

FIG. 12 shows the head of FIG. 11 in the operative, round cap bolt gripping position;

DETAILED DESCRIPTION OF THE PREFERRED EMBODIMENTS

Referring to FIGS. 1–4 there is shown wrench head 10 composed of seat member 12, operator sleeve 14 and four (in this example) peanut-shaped locking bodies 16. The bodies comprise first and second spherical portions 16*a* and 16*b* and a restricted neck or hip portion 16*c* therebetween. It should be emphasized that the diameter of the spherical portions 16*a* and 16*b* need not be identical, nor be linear alignment as will be readily understood in the light of the description to follow.

Figure 1:
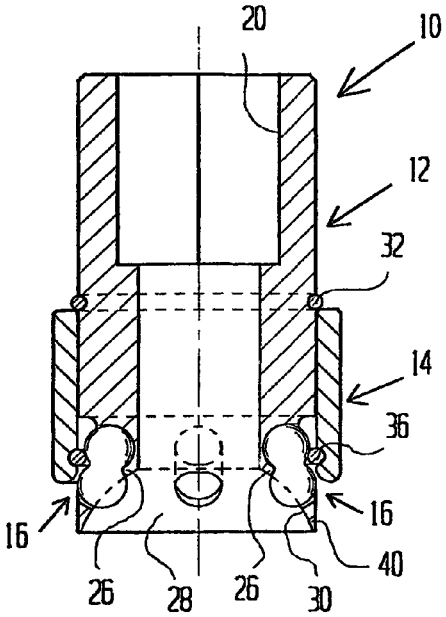
FIG. 1 is a partial cross-sectional view of a fastening tool according to one embodiment of the present invention in a position prior to gripping a round cap bolt.

Also shown in FIG. 1 is a round cap bolt 18.

In more detail, the wrench seat member 12 is formed with a square (or any other suitable shape) cavity 20 for inserting thereinto a wrench handle (not shown) in the conventional manner.

Figure 5:
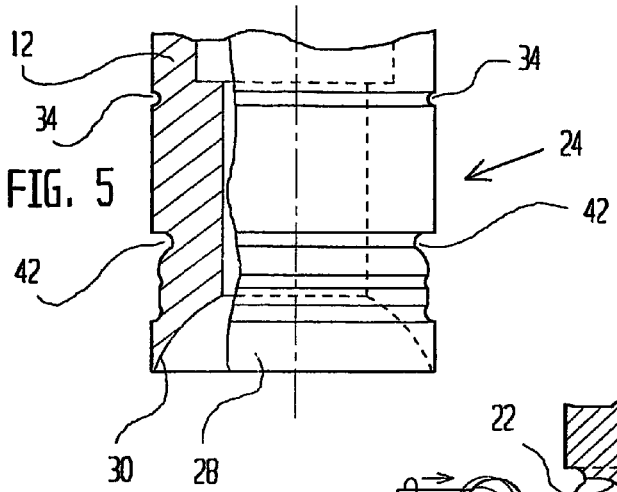
FIG. 5 shows a blank of the wrench head before preparation of the sockets.
Figure 6:
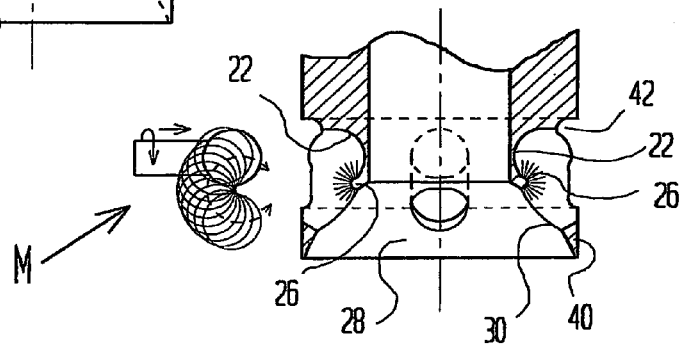
FIG. 6 illustrates the milling process by which the sockets are machined.

At the opposite end the seat member is formed with four spherical cavities fitting the upper parts 16*a* of the peanut-shaped locking bodies 16. This can be conveniently performed by using a spherical milling head M as schematically shown in FIG. 6, starting from blank work piece 24 shown in FIG. 5. The milling is progressed along a curved path so that a counter-lever rounded rib 26 is received configured to support neck-like portion 16*c* of the locking body 16 extending between portions 16*a* and 16*b*.

Figure 3:
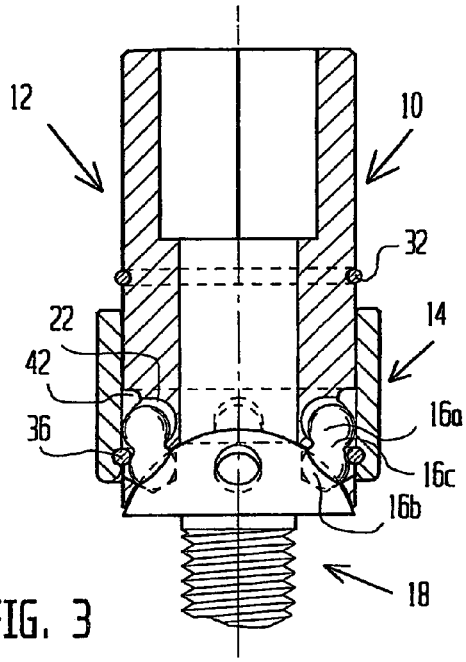
FIG. 3 shows the tool of FIG. 1 in the bolt gripping position.
Figure 2:
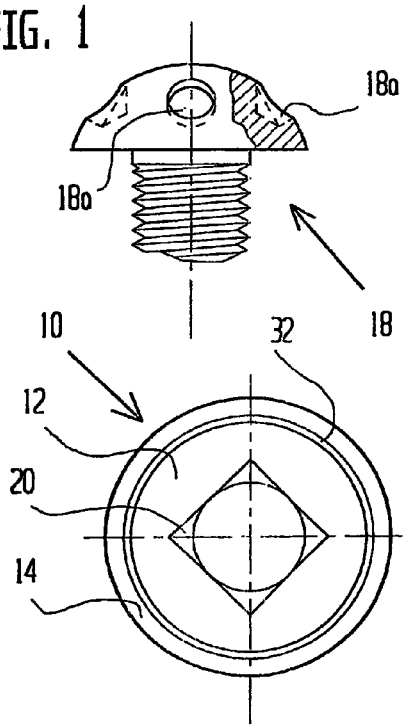
FIG. 2 is a top view of the tool of FIG. 1.
Figure 4:
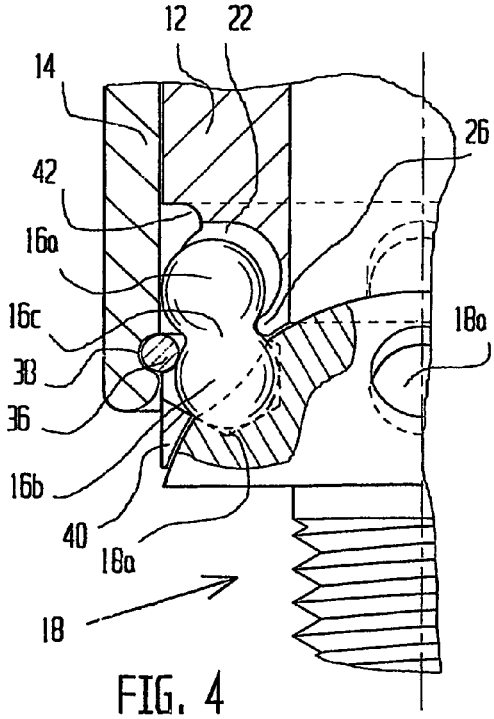
FIG. 4 is a detail of the tool and bolt of FIG. 1 on an enlarged scale.

It is thus clear that the bodies 16 are adapted to rock about the rib 26, supporting the neck portion 16*c*, from the preparatory position of FIGS. 1 (and 7) to the bolt gripping position of FIG. 3, and vise versa; as will be explained in detail further below, this rocking movement is one of the essential features of the present invention.

In the rocked position, the portions 16*b* bulge into a space 28 defined by a partly spherical recess 30 machined in the blank 24 (FIG. 5), conforming the cap of the bolt 18.

Figure 7:
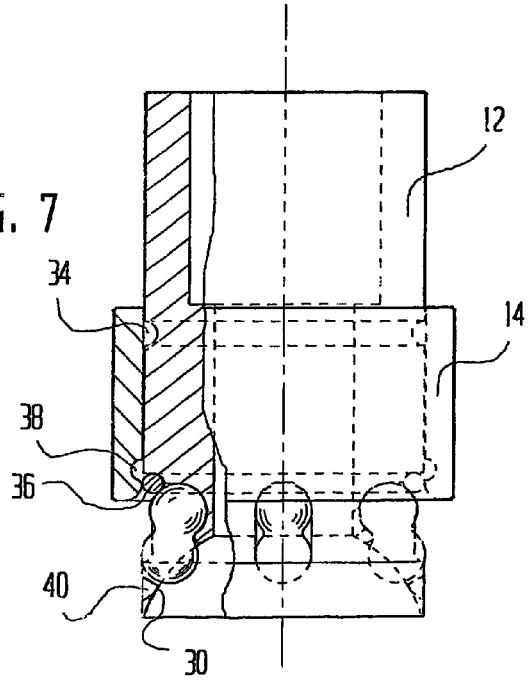
FIG. 7 illustrates a way of assembling the wrench operator sleeve and the locking bodies.

The rocking movement of the bodies 16 can be effected in many ways. Conveniently, and as exemplified in FIGS. 1–4 (but see alternative arrangements in FIGS. 8, 11 and 15), an operator sleeve 14 is employed, shiftable between an upper position delimited by first springy split-ring 32 seated in circular recess 34 (FIG. 1), and a lower position (FIG. 3) where second springy split-ring 36, received in circular recess 38 (see assembly process depicted in FIG. 7). This movement will cause the engagement of the second portions 16*b* by the ring 36 thereby imparting the said rocking movement of the lock bodies 16, about their respective ribs 26.

The round cap bolt 18 is formed with four cavities 18*a*, equi-angularly deployed (depending on that the same applies to the seat cavities 22), so that gripping thereof is perfected by the manipulation of the operator sleeve 14 in the manner analogue to that of the Prior Patent. However, and of cardinal importance as already mentioned above, the portions 16*b* reach into the cavities 18*a* by far more deeply than achieved by the Prior Patent system: half or even more of the perimeter, compared with barely one-third. In terms of torque transmission capability, this presents a most significant improvement as will be readily appreciated by those skilled in the art.

It will be further appreciated that the locking bodies 16 are much more firmly supported by the seat member 12 being strengthened by lower rim 40, which could not exist in the design of the Prior Patent system. It should however be admitted in this context that the number of different combinations regarding the location of the lock bodies 16 is limited compared with that offered by the Prior Patent system; hence, the wrench tool of this invention is not primarily useful for anti-theft applications.

The method of manufacturing and assembling of the wrench tool 10 was already briefly described above in conjunction with FIGS. 5–7. More attention should perhaps be directed to the preparation of circular recess 42 which enables the snap-mounting of the second split-ring 36 and then of the bodies 16, while the ring 14 is mounted last from above until the split-ring clicks into the recess 38. The operator sleeve is then lowered further over the body portions 16*a* and into the space around the neck portions 16*c*. Only then is the split-ring 32 placed inside the recess 34 to delimit the upwards movement of the operator sleeve 14 and avoid the unintentional dismantling of the unit.

Figure 8:
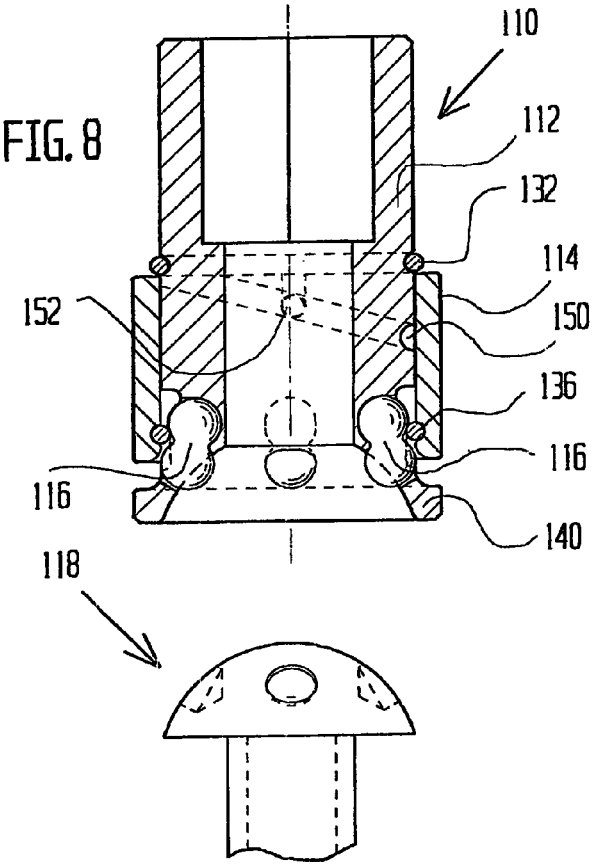
FIG. 8 shows an alternative way of mounting the wrench operator sleeve.
Figure 9:
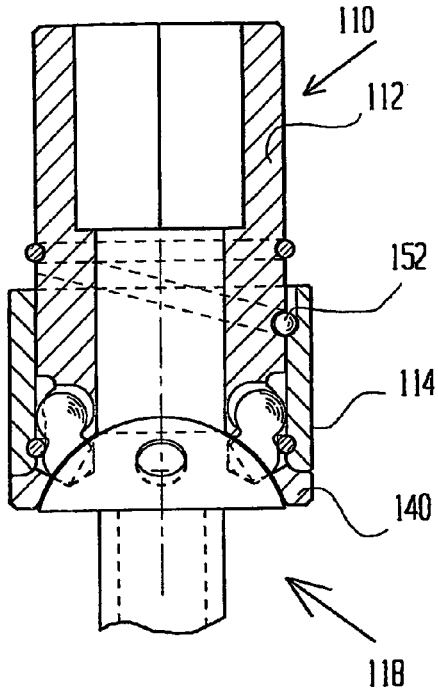
FIG. 9 shows the wrench of FIG. 8 in a round cap bolt gripping position.

FIGS. 8 and 9 show an embodiment essentially the same as the former but different with respect to the operator sleeve 114 mounting, namely that the manipulation thereof is attained by a rotary movement instead of sliding. For that purpose, a helical slot 150 is made at the circumference of the seat member 112 within which a ball 152 is adapted to slide when the sleeve 114 is rotated, which forces the sleeve to descend into the operative, bolt gripping position of FIG. 9.

In the additional modified embodiment shown in FIGS. 10 to 12 the lower split-ring (36; 136) is substituted by an arcuate surrounding lip 260 and the lower portion of the seat member 212, including the rim (40 in FIG. 1) does not exist.

In this design configuration, the operator sleeve 214 is initially assembled from below the wrench head seat member 212. The relative measurements of rocking support rib 226 on the one hand and of the edge of the lip 260 in the assembly position as shown in FIG. 10 on the other hand is such that the upper portion 216*a* can be passed through to its seat 222 (marked by a broken-line circle). The sleeve 214 is finally secured by pin 272 passing slot 274 the length thereof defining the up and down stroke of the sleeve between the preparatory and the gripping positions—FIGS. 11 and 12 respectively.

Figure 14:
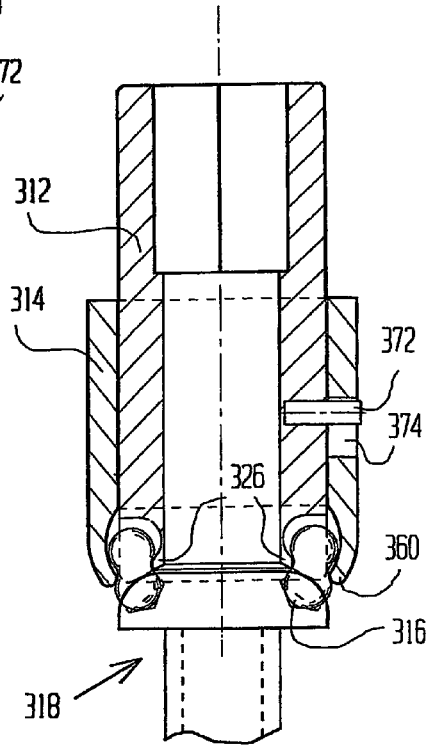
Figure 17:
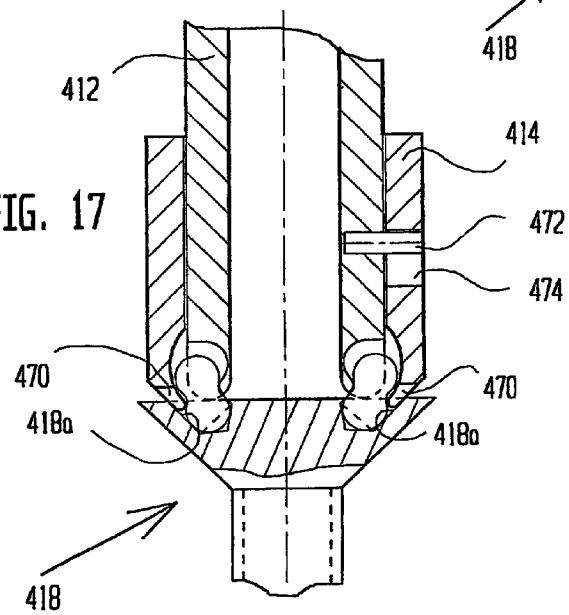
FIG. 17 shows the wrench of FIG. 16 in the flat head bolt gripping position.

The importance of this design version resides in that it enables the application of the wrench to PAN bolts and to flat-head (countersunk) bolts, as illustrated in FIGS. 14 and 17.

Figure 13:
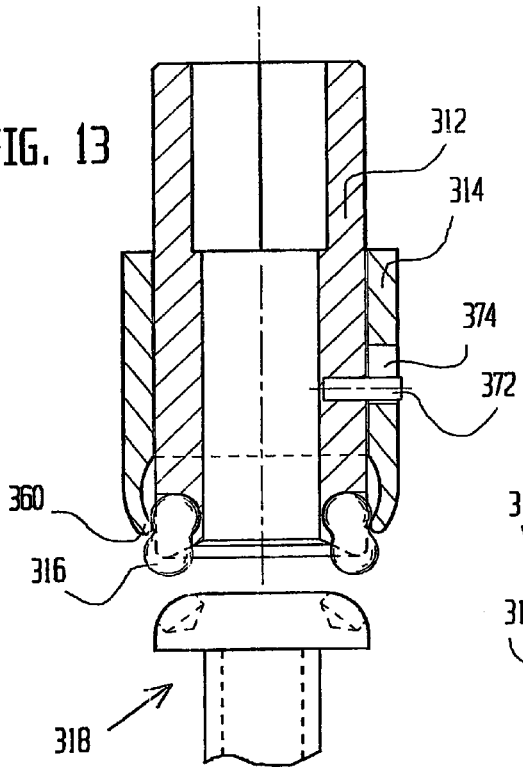
FIGS. 13 and 14 respectively show the head in the inoperative, preparatory position, and in the operative position with regard to a PAN head bolt.

Hence, PAN bolt 318 is shown in FIGS. 13 and 14 gripped by the locking bodies 316 after having been rocked by the lip 360.

Figure 15:
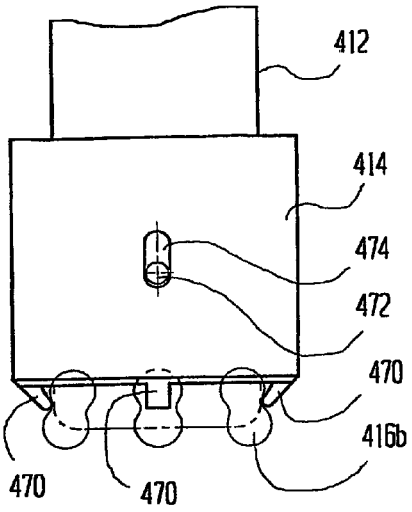
FIG. 15 is a side view of a still further modified wrench head suitable for countersunk bolts.
Figure 16:
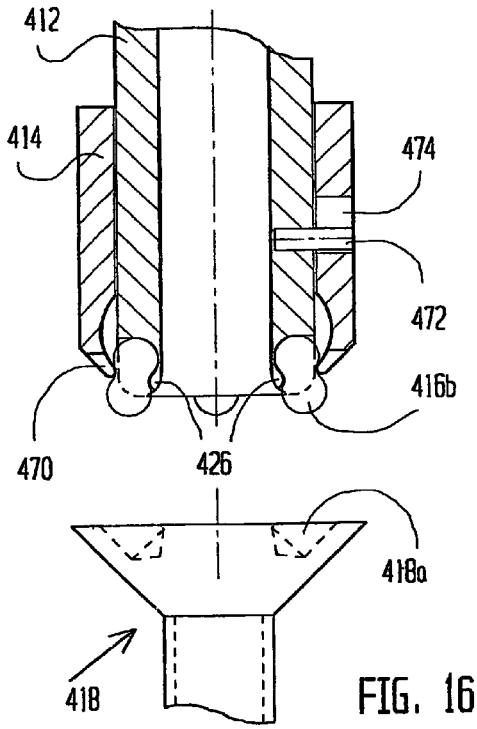
FIG. 16 is a cross-sectional view of the wrench head of FIG. 15.

In the embodiment of FIGS. 15–17, the formerly described continuous lip (260; 360) is in the form of four (in the present example) discrete fingers 470, which are small enough to be partly inserted into the respective bolt cavities as required for pushing the lower locking bodies portions 416*b* into the rocked position.

Note also that the reciprocating movement of the operator ring 414 needs in this case to be strictly linear. It is therefore mandatory to use the pin 472 and the slot 474, or other equivalent known arrangement for the linear guided movement of the sleeve 414.

Figure 18:
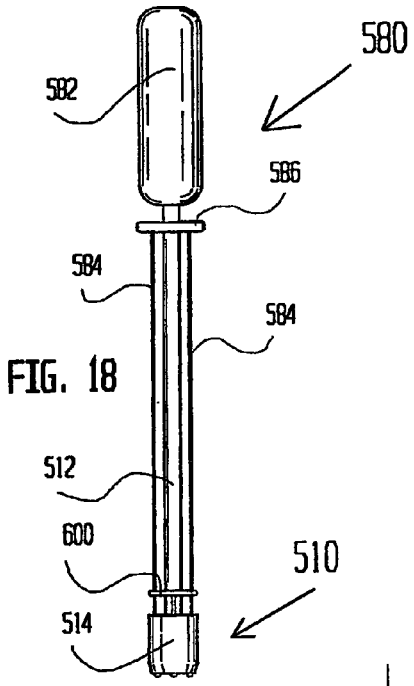
FIG. 18 shows a wrench tool of the invention operated by an extended handle.
Figure 19:
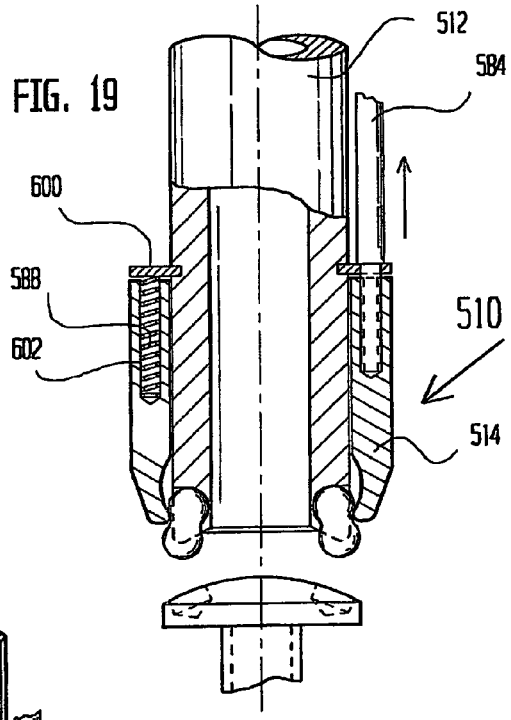
FIG. 19 is an enlarged cross-sectional view of the tool head of FIG. 18 in the inoperative position.
Figure 20:
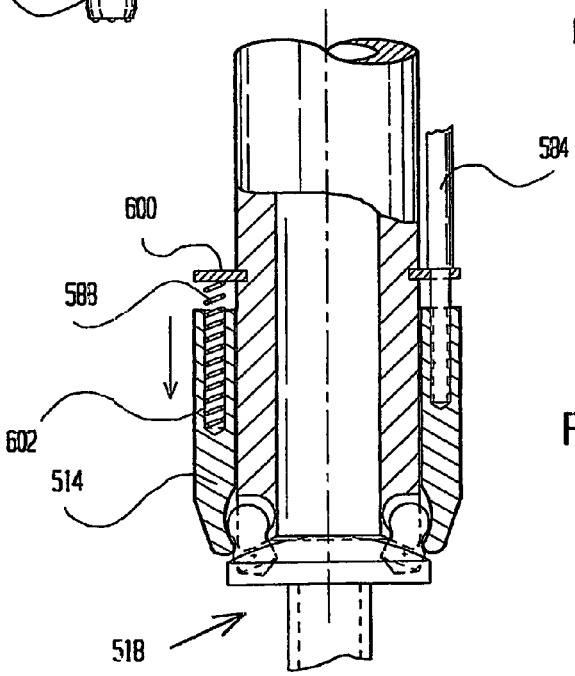
FIG. 20 shows the head of FIG. 19 in the operative position.

In FIGS. 18–20 there is exemplified the use of the wrench tool 510 remotely as a bolt key or screw-driver generally designated 580. The wrench seat member 512 is extended and provided with a hand-grip 582. The operator sleeve 514 is connected by extension rods 584 to a sliding disc 586 adapted to be pulled upwards by the user's fingers (not shown) against tension coil springs 588 normally forcing the operator sleeve 514 downwards by the spring being squeezed between stopper disc 600 and the bottom of blind bores 602.

The operation of the wrench key 580 is self-evident and needs not be explained in greater detail.

It has been thus established that the invention as so far disclosed provides a major technical advance over the prior art similar devices including, but not confined to, the Prior Patent.

Those skilled in the art to which this invention pertains will readily appreciate that numerous changes, variations and modifications can be effected without departing from the true spirit and scope of the invention as defined in and by the appended claims.

What is claimed is:

1. A fastening tool for tightening/untightening screw threaded fasteners such as bolts or nuts having a head formed with a series of at least three first cavities deployed therearound, the tool comprising:

at least three peanut-shaped displaceable locking bodies having a first substantially spherical portion, a second substantially spherical portion and a restricted neck portion therebetween;

the said first cavities being configured to receive the said first spherical portions;

a seat member formed with a series of at least three second cavities configured to receive the said second spherical portions; and means for rocking the locking bodies about their neck portions from a position wherein the second spherical portions are seated in the second cavities, into a position wherein the first spherical portions are seated in the said first cavities, and vice versa.

2. The fastening tool as claimed in claim 1 wherein the first cavities are cylindrical.

3. The fastening tool as claimed in claim 1 wherein the second cavities are spherical.

4. The fastening tool as claimed in claim 3 wherein said rocking means comprise a sleeve slideably manipulatable between a preparatory position wherein the second portions of the locking bodies are seated in the second cavities, and a bolt gripping position wherein the first portions of the locking bodies are seated in the first cavities.

5. The fastening tool as claimed in claim 4 wherein the said bolt heads are of round cap type.

6. The fastening tool as claimed in claim 4 wherein the said bolt heads are of the PAN type.

7. The fastening tool as claimed in claim 4 wherein the said bolt heads are of the countersunk type.

8. The fastening tool as claimed in claim 4 wherein the second cavities are formed with a counter-lever rounded rib by which the rocking movement of the locking bodies is attained.

9. The fastening tool as claimed in claim 8 wherein the sleeve is provided with a ring bulging inwardly so as to displace the locking bodies from one position to the other position thereof by engaging one or the other of the spherical portions during the manipulation of the sleeve.

10. The fastening tool as claimed in claim 8 wherein the sleeve (14) is provided with an arcuate surrounding lip bulging inwardly so as to displace the locking bodies from one position to the other position thereof by engaging one or the other of the spherical portions during the manipulation of the sleeve.

11. The fastening tool as claimed in claim 10 wherein the lip is discontinuous forming fingers at the respective locations thereof.

12. The fastening tool as claimed in claim 4 wherein the wrench head is connected to an extended handle, means being provided for remotely manipulating the sleeve.

13. The fastening tool as claimed in claim 12 wherein the remote manipulating means comprise spring urged rods coupled to the sleeve.

* * * * *